US012522942B2

(12) United States Patent
Kunze et al.

(10) Patent No.: US 12,522,942 B2
(45) Date of Patent: Jan. 13, 2026

(54) ELECTRODE AND APPARATUS FOR ELECTROLYTICALLY TREATING A WORKPIECE, ASSEMBLY FOR FORMING A CELL OF THE APPARATUS AND METHOD AND COMPUTER PROGRAM

(71) Applicant: Atotech Deutschland Gmbh & Co. KG, Berlin (DE)

(72) Inventors: Henry Kunze, Berlin (DE); Ferdinand Wiener, Berlin (DE); Britta Scheller, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 337 days.

(21) Appl. No.: 17/796,887

(22) PCT Filed: Feb. 5, 2021

(86) PCT No.: PCT/EP2021/052760
§ 371 (c)(1),
(2) Date: Aug. 2, 2022

(87) PCT Pub. No.: WO2021/156415
PCT Pub. Date: Aug. 12, 2021

(65) Prior Publication Data

US 2023/0062477 A1 Mar. 2, 2023

(30) Foreign Application Priority Data

Feb. 7, 2020 (EP) ..... 20156050

(51) Int. Cl.
*C25D 17/12* (2006.01)
*C25D 3/00* (2006.01)
(Continued)

(52) U.S. Cl.
CPC ..... *C25D 17/12* (2013.01); *C25D 3/00* (2013.01); *C25D 17/008* (2013.01); *C25D 21/12* (2013.01)

(58) Field of Classification Search
None
See application file for complete search history.

(56) References Cited

U.S. PATENT DOCUMENTS 6,322,673 B1 * 11/2001 Forand ..... C25D 7/0621 204/207
6,919,010 B1 7/2005 Mayer
(Continued)

FOREIGN PATENT DOCUMENTS

EP 1419290 B1 2/2005

OTHER PUBLICATIONS

English translation CN105369337 (Year: 2016).*
(Continued)

*Primary Examiner* — Stefanie S Wittenberg
(74) *Attorney, Agent, or Firm* — Renner, Otto, Boisselle & Sklar, LLP

(57) ABSTRACT

An electrode for an apparatus (1) for electrolytically treating a workpiece (3), the apparatus (1) being of a type arranged to convey the workpiece (3) with a surface to be treated past and directed towards a surface of the electrode, is divided into segments (23*a-e*) at at least this surface of the electrode. The segments (23*a-e*) are arranged next to each other in a first direction (x). Adjacent segments (23*a-e*) are separated from each other along respective segment edges (24*a-f*) such as to allow adjacent segments (23*a-e*) to be maintained at different respective voltages. The segment edges (24*a-f*) extend at least partly in a second direction (y) from a common value ($y_0$) of a co-ordinate in the second direction (y) to an edge (25,26) of at least an electrically conducting
(Continued)

part of the electrode surface, the second direction (y) being transverse to the first direction (x) and corresponding to a direction of movement of the workpiece, in use. The segment edges (24*a-f*) between at least one pair of adjacent segments (23*a-e*) extend along respective paths of which an angle to the electrode surface edge (25,26) decreases from the common value ($y_0$) of the co-ordinate to the electrode surface edge (25,26).

11 Claims, 9 Drawing Sheets

(51) Int. Cl.
*C25D 17/00* (2006.01)
*C25D 21/12* (2006.01)

(56) References Cited

U.S. PATENT DOCUMENTS

| | | | |
|---|---|---|---|
| 7,682,498 | B1 | 3/2010 | Mayer et al. |
| 9,040,128 | B2 | 5/2015 | Mai et al. |
| 10,017,869 | B2 | 7/2018 | Mayer |
| 2004/0232005 | A1 | 11/2004 | Hubel |
| 2016/0273124 | A1 | 9/2016 | He |

OTHER PUBLICATIONS

PCT/EP2021/052760; International Search Report and Written Opinion of the International Searching Authority dated Apr. 30, 2021.
Yang, L. et al., "Copper plating uniformity on resistive substrate with segmented anode", ECS Meeting Abstracts, 224th Meeting, Abstract # 2089, Nov. 1, 2013, Retrieved from the Internet: <URL: https://iopscience.iop.org/article/10.1149/MA2013-02/29/2089/pdf>.

* cited by examiner

ELECTRODE AND APPARATUS FOR ELECTROLYTICALLY TREATING A WORKPIECE, ASSEMBLY FOR FORMING A CELL OF THE APPARATUS AND METHOD AND COMPUTER PROGRAM

This application is a national phase of International Application No. PCT/EP2021/052760 filed 5 Feb. 2021, which claims priority to European Patent Application No. 20156050.5 filed 7 Feb. 2020, <each of>which is hereby incorporated herein by reference in its entirety.

TECHNICAL FIELD

The invention relates to an electrode for an apparatus for electrolytically treating a workpiece, the apparatus being of a type arranged to convey the workpiece with a surface to be treated past and directed towards a surface of the electrode,

- wherein the electrode is divided into segments at at least this surface of the electrode,
- wherein the segments are arranged next to each other in a first direction,
- wherein adjacent segments are separated from each other along respective segment edges such as to allow adjacent segments to be maintained at different respective voltages, and
- wherein the segment edges extend at least partly in a second direction from a common value of a co-ordinate in the second direction to an edge of at least an electrically conducting part of the electrode surface, the second direction being transverse to the first direction and corresponding to a direction of movement of the workpiece, in use.

The invention also relates to an assembly for forming a cell of an electrolytic processing apparatus.

The invention also relates to an electrolytic processing apparatus comprising at least one processing cell.

The invention also relates to a method comprising at least a computer-implemented step of designing an electrode of the above-mentioned type.

The invention also relates to a computer program.

BACKGROUND ART

Yang, L. et al., 'Copper plating uniformity on resistive substrate with segmented anode', *ECS Meeting Abstracts,* 224th Meeting, Abstract #2089, 1 Nov. 2013, Retrieved from the Internet: <URL: https://iop-science.iop.org/article/10.1149/MA2013-02/29/2089/pdf> relates to a method to improve the wafer-scale copper plating uniformity on resistive substrates using segmented anodes. In such a plating cell set-up, instead of one circular anode, multiple ring-shaped segments on which the input current can be controlled are used. Specifically disclosed is an anode configuration with three concentric segments.

U.S. Pat. No. 6,919,010 B1 discloses an anode assembly including a primary, azimuthally asymmetric anode and multiple secondary anode segments. The workpiece lies above the anode assembly and rotates about an axis substantially aligned with a centre axis of the anode assembly. In a typical embodiment, the footprint of the workpiece corresponds (at least roughly) to the perimeter of the anode assembly. Initially, to provide a large fraction ionic current to the central region of the workpiece (proximate the rotation axis), only the asymmetric anode is energised and provides current. The region of the assembly occupied by the segments do not provide any significant current during this initial phase of the plating process, when the terminal effect is most severe. Thus, at any given instant in time, a relatively large section of the workpiece periphery is not located over the top of the anode (or otherwise aligned with any portion of the anode). A plating cell has a vessel for holding electrolyte. A wafer holder holds a wafer, which has a seed layer thereon. A circuit distributes the plating current variably to each of two anodes, a primary asymmetric anode and a secondary asymmetric anode.

EP 1 419 290 B1 discloses a horizontal electroplating system for circuit boards comprising upper and lower anodes arranged behind one another in a transport direction of the circuit boards. The workpiece, in this case the circuit board, is held by at least one clamp, electrically contacted and transported from one anode to the next anode. Current is fed to the circuit board via contacts and the clamp. The anodes are divided into individual electrically isolated anode segments divided transverse to the transport direction. The anode segments together with a base layer on the circuit board form electrolytic partial cells. Each partial cell is fed with current from a separate current source, for instance its own segment rectifier. The circuit board to be treated constitutes the cathode of the partial cells with its upper layer to be metallised. In an embodiment, separating lines delineating the anode segments run at an angle $\alpha>0$ to the transport direction of the workpieces. Given sufficiently large obliqueness of the separating lines and thus of the segmentation of the anodes and insulation, almost all areas of the circuit boards to be produced are run briefly over or under the insulation area of each anode. In this way, the influence of the insulation on the layer thickness is balanced out. In the preferred embodiment, the angle $\alpha$ relative to the transport direction in side edge regions of the circuit boards, particularly in the region close to the clamps, should be chosen to be smaller than in the far-removed (contact-remote) region, since the voltage drop-offs in the base layer due to the large current arising there in the region close to the clamps are substantially greater per unit length than in the region removed from the clamps.

The current density across the workpiece can be made more uniform by increasing the number of segments, but there is a limit to this, due to the fact that the insulation between the segments also takes up some surface area. Moreover, the associated increase in the number of rectifiers required to maintain the segments at individual respective voltage levels increases the complexity and costs of the electroplating system. In practice, the attainable variation in thickness of the coating on the workpiece is not better than 13%.

Further improvements are attainable by influencing the electrolyte flow. In a current system with segmented anodes in which shielding devices in the form of apertured plates are provided between the anodes and the workpiece, plugs are inserted into certain apertures. However, determining which apertures to plug is complex and the actual insertion time-consuming. The plug pattern depends on the distance between the anode and the workpiece surface. This pattern must therefore be determined separately for each of the anodes past which the workpiece is conveyed and a new pattern must be determined and set if a workpiece with a different initial thickness is to be processed. Even then, the thickness variation is still not much better than 7%.

SUMMARY OF INVENTION

It is an object of the invention to provide an electrode, assembly, electrolytic processing apparatus, method and computer program that allow an improved uniformity of current density to be obtained across at least the majority of the extent of the workpiece in the first direction.

This object is achieved according to a first aspect by the electrode according to the invention, which is characterised in that the segment edges between at least one pair of adjacent segments extend along respective paths of which an angle to the electrode surface edge decreases from the common value of the co-ordinate to the electrode surface edge.

The electrode can be used as an anode in a cell of a galvanic plating apparatus, e.g. for plating planar workpieces in the form of panels or foils. The electrode can also be used as the cathode in an etching apparatus. The example of galvanic plating apparatus is used here to explain the effects of the electrode.

In such an apparatus, the workpiece is conveyed vertically or horizontally through an electrolyte. The workpiece is conveyed with a surface to be treated past and directed towards the electrode surface, the two surfaces being essentially parallel. There may be non-conducting structures between the surface to be treated and the electrode surface, e.g. shielding structures.

At the start of the plating process, there is only a very thin conducting layer on the surface of the workpiece, e.g. deposited by means of vapour deposition or electroless plating. The workpiece is only contacted electrically at one or both edges (seen in the first direction, which is transverse to the direction of movement) by clamps. The resistance of the thin conducting layer is relatively large compared with that of the electrolyte. The voltage at the surface of that layer therefore drops off relatively steeply in the first direction. Without segmentation of the electrode (functioning as the anode in the plating example), there would be a large current density near the clamp or clamps. Since the current density through the electrolyte bath from the surface of the workpiece to the anode determines the rate at which the layer thickness increases, non-uniformities in the current density lead to non-uniformities in the thickness of the deposited layer of plating material.

The proposed electrode is divided into segments at at least the surface of the electrode facing the surface to be plated. These segments are mutually electrically isolated or weakly coupled, so that they can be held at different voltages by individual respective rectifiers. The current passing from each segment to the workpiece surface can be controlled individually. Because the segments are arranged next to each other in the first direction, the direction in which the voltage at the workpiece surface drops off, a more uniform voltage difference across the electrolyte bath can be maintained.

Adjacent segments are separated from each other along respective segment edges. These segment edges extend partly in a second direction, the second direction being transverse to the first direction and corresponding to a direction of movement of the workpiece, in use.

The segment edges extend from a common value of a co-ordinate in the second direction to an edge of at least an electrically conducting part of the electrode surface. The common value of the co-ordinate may correspond to an opposite edge in the second direction. It may alternatively correspond to the middle of the electrode, in cases where the paths of the segment edges are comprised of two sections that are mirror images of each other. The segment edges will generally extend to a respective end point at the edge of the electrically conducting part of the electrode. The values of the co-ordinate in the second direction at the respective end points will generally deviate by less than 10%, for example less than 5%, from a mean value of that co-ordinate at these end points. In most embodiments, the values of the co-ordinate in the second direction at the respective end points will be the same. The edge will thus be essentially straight. This is generally the case for electrodes for an apparatus for electrolytically treating a workpiece, where the apparatus is of a type arranged to convey the workpiece past a surface of the electrode. Otherwise, the workpiece would not be processed equally across the width (corresponding to the first direction) of the workpiece. Furthermore, multiple electrodes of this type can then be arranged in a row in the second direction, corresponding to the direction of movement of the workpiece, in use, without large uneven gaps between successive electrodes.

If the segment edges were to extend only in the second direction—this means they would be straight lines—the result would be lines on the surface of the workpiece, where the gap separating the edges of adjacent segments prevents a flow of current through the electrolyte bath. Moreover, there would still be non-uniformity of current density in the first direction between the co-ordinates of the segment edges, i.e. within sections corresponding to electrode segments.

The latter effect is countered by the fact that the segment edges between at least one pair of adjacent segments extend along respective paths of which an angle to the electrode surface edge decreases from the common value of the co-ordinate to the electrode surface edge. Because the angle decreases, the paths are not straight lines, but curves or piecewise linear curves. At each co-ordinate in the first direction, the workpiece passes two segments for different respective durations, where the ratio between the durations changes non-linearly to compensate for the non-linear voltage drop-off in the conducting layer on the surface of the workpiece. As a result, the average current density is relatively uniform in the first direction. This is at least the case for a central region away from the edges, since edge effects due to the flow of electrolyte and the contacting of the workpiece may be a further cause of non-uniformity.

The segment edges between any pair of adjacent segments will generally have the same shape. The opposing segment edges of each segment may extend along respective paths having different shapes.

In an embodiment, at least within each half of the electrode seen in the first direction, the paths extend in a same sense in the first direction from the common value of the co-ordinate to the electrode surface edge.

That is to say that the paths are all inclined in the same direction, at least within each half of the electrode seen in the first direction. The direction of movement in the first direction along each path of a hypothetical observer travelling along the path from the point at which the second co-ordinate is at the common value to the electrode surface edge has the same sign. The sign is both the same along the extent of each path, i.e. does not change along the path, and the same for all the paths concerned (all of them or all of them within each respective half). For applications in which the workpiece is contacted at both opposite edges, the paths extend in a same sense in the first direction from the common value of the co-ordinate to the electrode surface edge only within each half of the electrode. For applications in which the workpiece is contacted at only one edge, all the paths extend in the same sense in the first direction from the common value of the co-ordinate to the electrode surface edge.

In an embodiment, the paths from the common value of the co-ordinate to the electrode surface edge are curves.

Compared to piecewise linear curves, this embodiment achieves a more uniform current density average.

In an embodiment, at least the electrically conducting part of the electrode surface comprises two halves, seen in the second direction, wherein respective sections of the segment edges in one half are a mirror image of respective sections of the segment edges in the other half with respect to a line of symmetry located at the common value of the co-ordinate.

This allows the paths to have a higher inclination. That in turn helps avoid the striping effect mentioned above that is due to sections of the workpiece surface passing only or nearly only past the non-conducting separations between segments.

In an embodiment, a point at the electrode surface edge on a path of a first of the segment edges of each segment is at the same co-ordinate value or removed in the first direction from a point at the common value of the co-ordinate on the path of the other of the segment edges of that segment.

If one labels the co-ordinate in the first direction as the x-co-ordinate and the co-ordinate in the second direction as the y-co-ordinate, a first edge of a segment extends from a point $(x_1,y_0)$ at the common value $(y_0)$ of the y-co-ordinate to the point $(x_2,y_1)$ at the electrode surface edge. The second edge of the segment extends from a point $(x_3,y_0)$ at the common value $y_0$ of the y-co-ordinate to the point $(x_4,y_1)$ at the electrode surface edge. In this embodiment, $x_3 \geq x_2$. As a result, there are no values of the co-ordinate x in the first direction for which the workpiece surface passes under or over an insulating barrier between adjacent segments more than once or twice. Furthermore, each point on the workpiece surface faces at most two segment voltages, simplifying the configuration of the apparatus cell comprising the electrode.

In an embodiment, at least within each half of the electrode seen in the first direction, a width of the segments, corresponding to a distance between the edges of a segment at the common value of the co-ordinate, increases from segment to segment in the first direction.

This further takes account of the fact that the voltage at the workpiece surface falls off most steeply at the edge where the workpiece is contacted. Where the electrode is intended for applications in which the workpiece is held at both edges by clamps that determine its voltage, then the above-mentioned condition would be true within each half of the electrode, seen in the first direction, with the width being smallest where the two halves join.

Such an effect is also achieved in an embodiment in which, at least within each half of the electrode seen in the first direction, an angle to the electrode surface edge of the paths of a pair of segment edges between a pair of adjacent segments at the surface edge increases from pair to pair in the first direction.

The segment edges closest in the first direction to the electrode edge at which the workpiece is electrically contacted have a relatively small inclination, whereas those further removed from that electrode edge have a relatively large inclination. Here also, where the electrode is intended for applications in which the workpiece is held at both edges by clamps that determine its voltage, then the above-mentioned condition would be true within each half of the electrode, seen in the first direction, with the angle being smallest for the pairs closest to where the two halves join.

In an embodiment, the electrode comprises a mesh electrode.

In particular, the electrode surface, and thus the segment surfaces, may be formed by the mesh. An effect is that electrolyte can flow through the electrode. The electrolyte between the electrode and the workpiece surface can thus be replenished relatively uniformly. This uniform replenishment is achievable without providing conduits or the like between the electrode and the workpiece. This in turn allows for relatively uniform current density averages to be attained.

In an embodiment, the electrode is at least in accordance with a design obtainable by executing a method according to the invention, if not obtainable by executing a method according to the invention.

According to another aspect, the assembly according to the invention for forming a cell of an electrolytic processing apparatus comprises at least one electrode according to the invention.

There may of course be two such electrodes in cells for processing both sides of a planar workpiece simultaneously, for example. The cell further includes at least one device for filling a space between the workpiece surface and the electrode with an electrolyte. This at least one device may be configured to circulate the electrolyte, such that the electrolyte passes out of the space between the workpiece surface and the electrode through a window at an edge of the electrode in the first direction.

An embodiment of the cell further comprises at least one shielding device, extending in the first and second directions in front of the electrode surface of one of the at least one electrodes.

This embodiment helps prevent contact between the electrode and the workpiece, in particular where the workpiece is a relatively thin workpiece supported only at one or more of the edges of the workpiece. The shielding device may also be used to influence the electric field between the surface of the workpiece to be treated and the electrode surface. The shielding device can in particular be used to improve the uniformity of the current density average, e.g. by compensating for edge effects.

In an example of such an embodiment, the shielding device comprises a plate, provided with a multitude of through-going channels pervious to liquid and distributed in the first and second directions.

An effect is that electrolyte can flow through the shielding device. The electrolyte between the electrode and the workpiece surface can thus be replenished relatively uniformly without providing conduits or the like between the electrode and the workpiece. The distribution and/or size of the channels can be locally non-uniform in order to compensate for other non-uniformities. Locally allowing more electrolyte through reduces the bath resistance and increases the current density, thus compensating for distortions of the electric field due to other structures or edge effects. Regular flow may be achieved where the channels are distributed uniformly and regularly with a certain pitch in accordance with a grid. Local increases in permeability may be achievable by locally interconnecting adjacent channels. Local decreases in permeability may be achievable by locally omitting channels at certain positions on the grid.

In a particular version of this example, all paths extend in a same sense in the first direction from the common value of the co-ordinate to the electrode surface edge, and an integral of a liquid-pervious area of the through-going channels in a strip of the plate extending in the second direction along an edge of the plate in front of an edge of the electrode surface approached by the paths as they progress from the common value of the co-ordinate to the electrode surface edge is lower than in an adjacent parallel strip of the plate of the same width.

The integral of a liquid-pervious area of the through-going channels in the strip of the plate extending in the second direction along an edge of the plate in front of an edge of the electrode surface approached by the paths as they progress from the common value of the co-ordinate to the electrode surface edge may be lower than an average value for all parallel strips of the plate of the same width. When all paths extend in a same sense in the first direction from the common co-ordinate to the electrode surface edge, the electrode is configured for use with workpieces that are electrically contacted at only one edge. A strip at the edge of the shielding device plate facing the opposite edge of the workpiece is relatively impervious to liquid. There is a window at this edge, through which electrolyte passes out of the space between the shielding device and the workpiece surface. Without the relatively closed strip, a relatively high current density average would be achieved at his edge. This would give rise to a locally increased thickness of the layer formed in a plating apparatus comprising the assembly. In other words, an imaginary strip at the edge of the shielding device plate that is furthest away from the edge located where the electrode is clamped is relatively impervious to liquid.

In an example of the embodiment of the assembly in which the cell further comprises at least one shielding device, extending in the first and second directions in front of the electrode surface of one of the at least one electrodes, and the shielding device comprises a plate, provided with a multitude of through-going channels pervious to liquid and distributed in the first and second direction, for each segment, at least one electrical contact is provided at a respective location having a co-ordinate in the first direction, and an integral of a liquid-pervious area of the through-going channels in a strip of the plate extending in the second direction at the co-ordinate in the first direction is lower than in adjacent parallel strips of the same width.

The strip that lets through less electrolyte compensates for the increased current density average that would otherwise be established at the co-ordinate in the first direction of the electrical contact.

In an example of the embodiment of the assembly in which the cell further comprises at least one shielding device, extending in the first and second directions in front of the electrode surface of one of the at least one electrodes, and the shielding device comprises a plate, provided with a multitude of through-going channels pervious to liquid and distributed in the first and second direction, the plate is fixed by at least one fastener extending in a direction transverse to the plate and located at an associated position having a co-ordinate in the first direction, the fastener having a cross-section with a certain width at a surface of the plate distal to the electrode, wherein an integral of a liquid-pervious area of the through-going channels in sections of a strip of the plate with the certain width extending in the second direction at the co-ordinate in the first direction is higher than in adjacent sections of adjacent parallel strips of the same width.

The fastener prevents current flow. This is because the fastener acts as an electrically insulating element, even if made of electrically conducting material. This effect is compensated for by the fact that the remainder of the strip in which the fastener lies has a higher permeability to the electrolyte.

In an example of the embodiment of the assembly in which the cell further comprises at least one shielding device, extending in the first and second directions in front of the electrode surface of one of the at least one electrodes, and the shielding device comprises a plate, provided with a multitude of through-going channels pervious to liquid and distributed in the first and second direction, an integral of a liquid-pervious area in a strip of the plate) extending in the second direction along an edge of the plate in front of an edge of the electrode from which the paths diverge as they progress from the common value of the co-ordinate to the electrode surface edge is higher than in an adjacent parallel strip of the plate of the same width.

The integral of a liquid-pervious area of the through-going channels in the strip of the plate extending in the second direction along an edge of the plate in front of an edge of the electrode surface approached by the paths as they progress from the common value of the co-ordinate to the electrode surface edge may be lower than an average value for all parallel strips of the plate of the same width.

The integral of a liquid-pervious area in a strip of the plate extending in the second direction along the edge of the plate in front of an edge of the electrode from which the paths diverge as they progress from the common value of the co-ordinate to the electrode surface edge may in particular be higher than an average value for all parallel strips of the plate of the same width. More electrolyte is led through the plate of the shielding device at an edge of the plate in front of an edge of the electrode at which the workpiece is electrically contacted. This promotes current flow through the surface of the workpiece as opposed to current flow directly from the electrode to the clamp or similar device electrically contacting the workpiece.

In an example of the embodiment of the assembly in which the cell further comprises at least one shielding device, extending in the first and second directions in front of the electrode surface of one of the at least one electrodes, and the shielding device comprises a plate, provided with a multitude of through-going channels pervious to liquid and distributed in the first and second direction, the plate is made of electrically insulating material.

This simplifies mounting of the plate, amongst others. Fasteners for mounting the plate will generally have to extend at least between the plate and the electrode at locations away from the edges. The fasteners can be made of electrically conducting material.

An embodiment of the assembly further comprises at least one further electrode extending in the second direction along an edge of one of the at least one electrodes and in a third direction transverse to the first and second directions.

The further electrode extends in the second direction and in a direction transverse to both the first and second direction. This further electrode may in particular be provided at the edge of the segmented electrode facing the edge of the workpiece at which the workpiece is electrically contacted, e.g. by one or more clamps. Where the segmented electrode functions as an anode, the further electrode is also arranged to function as an anode, and is also referred to herein as a clamp anode. The clamp anode is a structure of which the dimensions in the third and second direction are larger than the dimension in the first direction, e.g. an order of magnitude (ten or even a hundred times) larger. The clamp anode, in use, is provided with a controlled current, such as to affect metal deposition on the workpiece near the edge where the workpiece is contacted by a clamp. Because the clamp may not be completely shielded, some current from the segmented anode would otherwise flow to the clamp, as opposed to the workpiece. The clamp anode on the one hand prevents current from flowing from the segmented anode to the clamp and an edge strip of the workpiece. On the other hand, the clamp anode compensates for any decrease of metal deposition due to current flowing from the segmented anode to the clamp instead of to the workpiece. Similar effects are obtained in embodiments in which the segmented electrode and further electrode function as cathodes and the workpiece is contacted at the edge to function as an anode.

In a particular example of this embodiment, an electrically insulating shield is provided between the further electrode and the segmented electrode. This electrically insulating shield may take the form of a surface layer on a surface of the further electrode facing the segmented electrode.

According to another aspect, the electrolytic processing apparatus according to the invention comprises at least one processing cell, the processing cell comprising at least one assembly according to the invention.

As mentioned, the electrolytic processing apparatus may be for electroplating or etching, i.e. for building up or breaking down an electrically conducting layer of material on a surface of the workpiece.

An embodiment of the electrolytic processing apparatus comprises a plurality of the processing cells and a conveying system for conveying a workpiece through and between the cells.

The conveying system may be a vertical conveying system, in which the surface of the workpiece extends essentially vertically, or a horizontal conveying system, in which the surface of the workpiece extends essentially horizontally as the workpiece is moved through and between the cells.

In an example of this embodiment, the conveying system comprises at least one clamp for releasably holding a planar workpiece at an edge of the planar workpiece whilst the workpiece is conveyed through and between the cells.

The workpiece can remain unsupported in regions removed from the edge at which the workpiece is held by the at least one clamp. This helps prevent attrition of the surface of the workpiece. Processing uniformity is also improved, in that there are no support structures between the workpiece and the electrode other than at the edge or edges of the workpiece where the workpiece is held by the at least one clamp. The workpiece can thus be processed on both sides in one cell, even where the conveying system is a horizontal conveying system. The conveying system may use more than one clamp per workpiece. The at least one clamp may be mounted on an endless chain or belt. Each clamp may close automatically at a first cell and disengage from the workpiece automatically at a last of a series of cells through which the workpiece is conveyed. The conveying system may comprise clamps for holding the workpiece at both of opposite edges in the first direction (i.e. the direction transverse to the direction of movement). In that case, the feed points of the applied current may be mirror images with respect to a line of symmetry of the workpiece.

In a particular version of this example, at least one of the at least one clamps comprises an arm comprising an electrically conducting part for electrically contacting the workpiece when pressed against a major surface of the workpiece, so that the workpiece can function as an electrode.

Thus, the workpiece is both held at a particular potential and conveyed through the apparatus. Because a clamp is used, the workpiece is electrically contacted at the surface to be processed.

In a specific example, at least an end section of the arm for engaging the workpiece comprises an electrically conducting core part covered by an electrically insulating shielding except for a surface section for engaging the major surface of the workpiece.

This helps avoid coating or stripping of the arm and promotes processing of the surface of the workpiece where this surface is held by the clamp, by forcing current to flow through the electrically conducting layer on the workpiece surface.

According to another aspect, the method according to the invention comprises at least a step of designing an electrode according to the invention, wherein the design step includes determining the shapes of the paths.

The electrode can thus be adapted to the configuration of the processing cell in which the electrode is to be used. In a multi-cell apparatus, the path shapes may differ between electrodes for different cells, for example. The path shapes may in particular be determined in dependence on at least one of the number of segments, the extent of the electrode surface in the first direction, the resistivity of the electrolyte, the distance between the workpiece and the electrode surface, the resistivity and thickness of an electrically conducting layer at the surface of the workpiece and the extent of the electrode surface in the second direction.

In an embodiment of the method, determining the shapes of the paths includes determining coefficients of a polynomial, e.g. a second-degree polynomial, of the co-ordinate in the first direction, the polynomial representing a co-ordinate in the second direction.

In plan view onto the electrode surface, the path from the common value of the co-ordinate in the second direction to the electrode surface edge will thus be at least based on a polynomial, e.g. be a section of a parabola. A further step of the design step may include superimposing a deviation onto the parabola or higher-order polynomial. The process of determining the coefficients may be an iterative process.

In an embodiment, the coefficients are obtained by calculating a voltage drop-off function, being a function of the co-ordinate in the first direction and representing a voltage change in the first direction along the surface of the workpiece.

The voltage drop-off function may be a second order polynomial function. The coefficients may correspond to the coefficients of the voltage drop-off function, scaled by the dimension of the electrode surface in the first direction and divided by the voltage difference between the adjacent segments of which the edges extend along the path of which the shape is to be determined.

An embodiment of the method further includes manufacturing an electrode to the design.

According to another aspect, the computer program according to the invention comprises instructions which, when the program is executed by a computer, cause the computer to carry out the design step of a method according to the invention.

The computer program may be embodied in one or more computer-readable non-transitory storage media.

BRIEF DESCRIPTION OF DRAWINGS

The invention will be described in further detail with reference to the accompanying drawings, in which.

DESCRIPTION OF EMBODIMENTS

Figure 1:
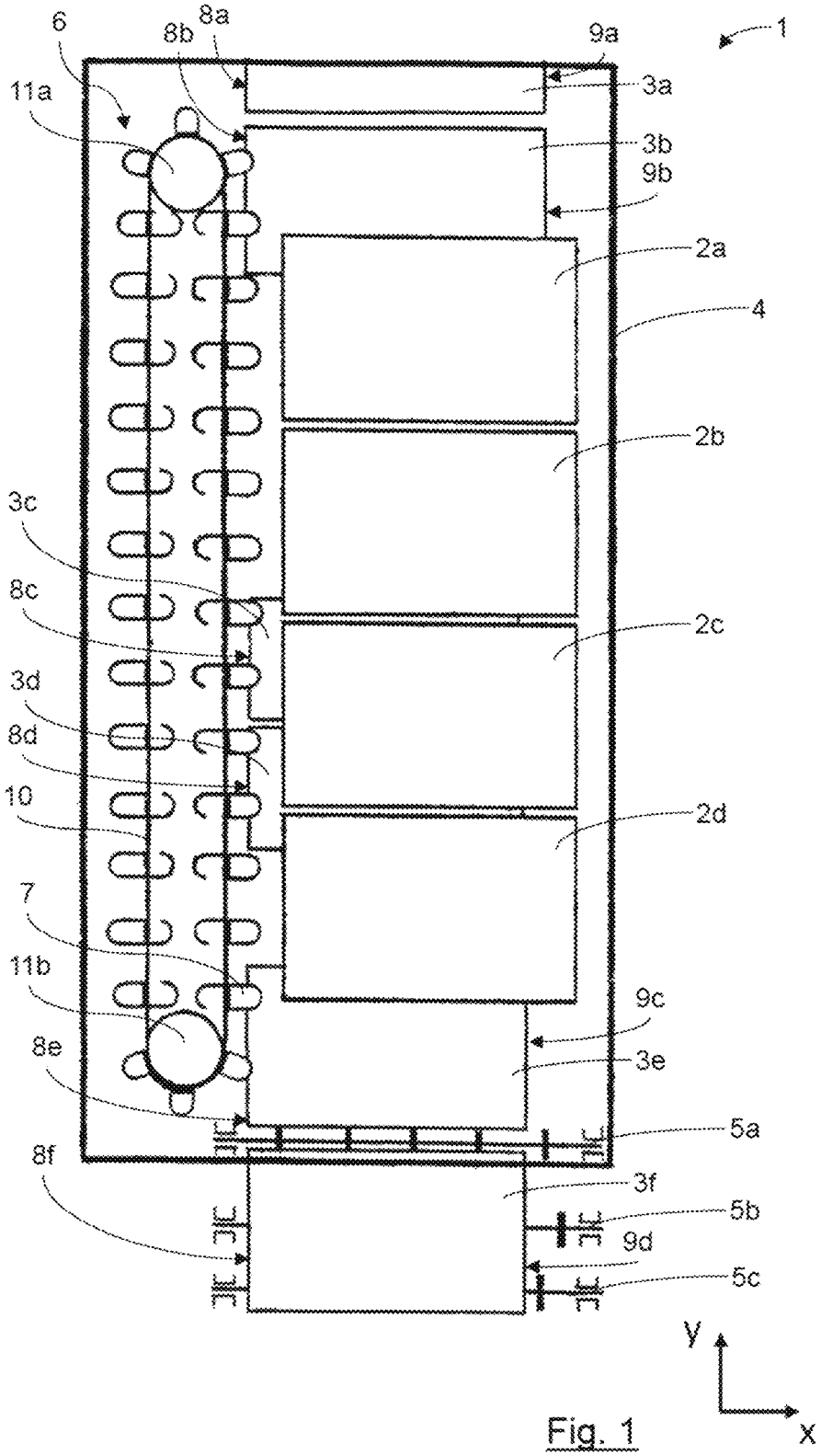
FIG. 1 is a very schematic top plan view of an electrolytic processing apparatus.

An electroplating apparatus 1 comprises a number of processing cells 2*a-d* for plating a planar workpiece 3*a-f*. The planar workpiece 3*a-f* may be a foil or panel, e.g. made mainly of dielectric material. The surfaces parallel to the plane of the workpiece are referred to herein as the major surfaces. At least one of these major surfaces is to be plated by the apparatus 1. This includes plating the side walls of any vias through the workpiece 3*a-f* or of trenches in the workpiece 3*a-f*.

Only the electrolytic plating apparatus 1 is described and illustrated here. This apparatus 1 will generally be preceded by apparatus for effecting preliminary processing steps, including ablation, desmearing, ionic activation and electroless deposition to form an electrically conducting precursor layer on the workpiece 3*a-f*.

It is convenient to define a first direction x, the dimension of the workpiece 3*a-f* also being referred to herein as the width. A second direction y, transverse to the first direction x, corresponds to a direction of movement of the workpieces 3*a-f* through the apparatus 1.

The apparatus 1 comprises an enclosure 4 defining a bath of circulated electrolyte. Rollers 5*a-c* support the workpieces 3*a-f* up to a point of entry into the enclosure 4, where they are engaged by a conveying system 6, shown schematically as comprising a series of clamps 7 for engaging the major surfaces of the workpieces 3*a-f* at a proximal edge 8*a-f*. A distal edge 9*a-d* is located at what is referred to herein as a window of each cell 2*a-d*, where the electrolyte flows out of the cell 2*a-d*. In the illustrated embodiment, the workpieces 3*a-f* are not held at the distal edge 9*a-d*. The workpieces 3*a-f* are also not supported by any solid structures between the edges 8,9. The workpieces 3*a-f* are immersed in the electrolyte, however. In alternative embodiments, support elements may be provided. The workpieces 3*a-f* may also be clamped on both sides, seen in the first direction x.

The clamps 7 automatically engage the workpieces 3*a-f* as the latter enter the enclosure 4 and disengage when the workpieces 3*a-f* leave the enclosure 4. The clamps 7 are supported on an endless belt 10, which may be a belt with a toothed profile or a chain, for example, driven by one or more drums 11*a,b* around which the endless belt 10 is arranged and by which the endless belt 10 is supported.

It is noted that FIG. 1 is schematic. In a practical implementation, the clamps 7 will extend into the cells 2*a-d*, so that the workpieces 3*a-f* protrude only little or not at all at their proximal edges 8*a-f*.

The clamps 7 comprise an arm 12 (FIG. 2) on each side of the workpiece 3*a-f*. The arm 12 comprises an electrically conducting core part 13 covered by an electrically insulating shielding 14 except for a surface section 15 for engaging the major surface of the workpiece 3. The or each clamp 7 that engages the workpiece 3 forms part of an electrical circuit comprising the workpiece 3, which functions as a cathode, and an anode 16.

In a cell 2 for plating both major surfaces of the workpiece 3, the arrangement is mirrored. The present discussion will focus on only those components for plating one major surface of the workpiece 3, in the illustrated embodiment the major surface facing upwards.

Figure 2:
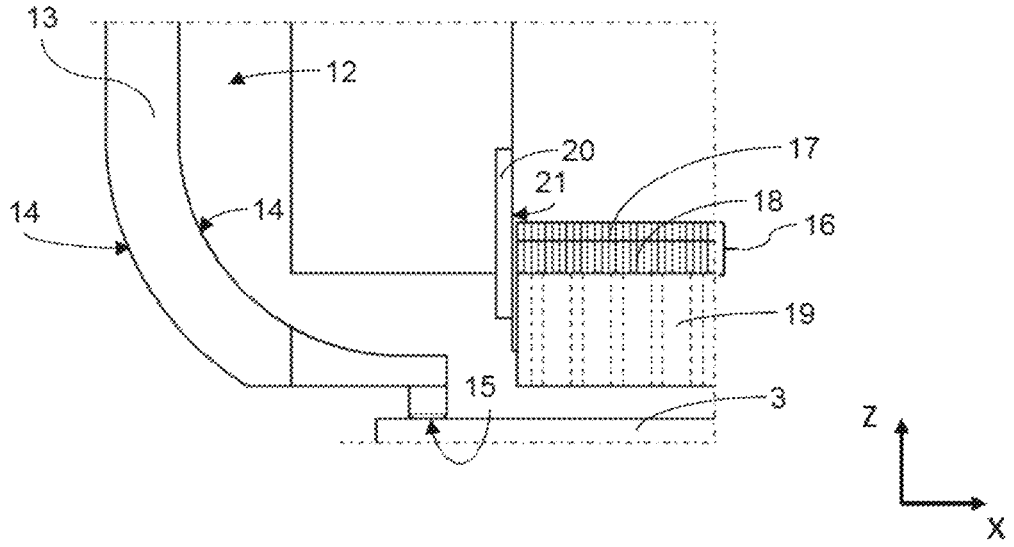
FIG. 2 is a cross-sectional detailed view of a clamp arm for contacting a workpiece conveyed through the electrolytic processing apparatus.

The anode 16 of the example comprises two layers 17,18 (FIG. 2). In alternative embodiments, there may be one layer or even more layers. At least a lower layer 18 proximate to the workpiece 3 comprises mesh sections. The mesh is pervious to the electrolyte. An upper layer 17 may also be a mesh layer or, as in the illustrated example, a layer made of apertured plate sections. Electrolyte can thus flow through the anode 16 towards the workpiece 3.

A shielding device comprising a shielding plate 19 made of electrically insulating material and provided with through-going channels is situated between the anode 16 and the workpiece 3. The shielding plate 19 functions to protect against short-circuits due to contact between the workpiece 3 and the anode 16. The shielding plate 19 may be omitted in some embodiments. The shielding plate 19 extends in the first direction x and the second direction y in front of the anode surface facing the workpiece 3. The shielding plate 19 may be essentially co-extensive with the anode 16. In the illustrated embodiment, there is a slight deviation, as will be explained.

In the illustrated embodiment, a clamp anode 20 (FIG. 2) extends in the second direction y along an edge 22 (FIGS. 3 and 4) proximal to the clamp 7 and in a third direction z, transverse to the first direction x and the second direction y. The clamp anode 20 is provided with a separately controlled current supply (not shown in detail). The clamp anode 20 is arranged to a certain extent to prevent current from flowing from the anode 16 to the clamp 7 or a region of the workpiece 3 at an edge of the workpiece 3 where the workpiece 3 is contacted by the clamp 7. In addition, the clamp anode 20 compensates for deposition of metal on the clamp 7 instead of the workpiece 3 by providing an additional current flow to the workpiece 3. This further contributes to the uniformity of the layer formed on the workpiece 3. If the workpiece 3 is a printed circuit board, the clamp anode 20 provides a plated edge region, generally up to 25 mm wide, which is needed for contacting at subsequent processing stages, In an embodiment, a surface 21 of the clamp anode 20 facing the anode 16 is covered by electrically insulating material. This is useful because the current from the clamp anode 20 is controlled independently of that from the anode 16, so that there may be a potential difference between the two.

Figure 3:
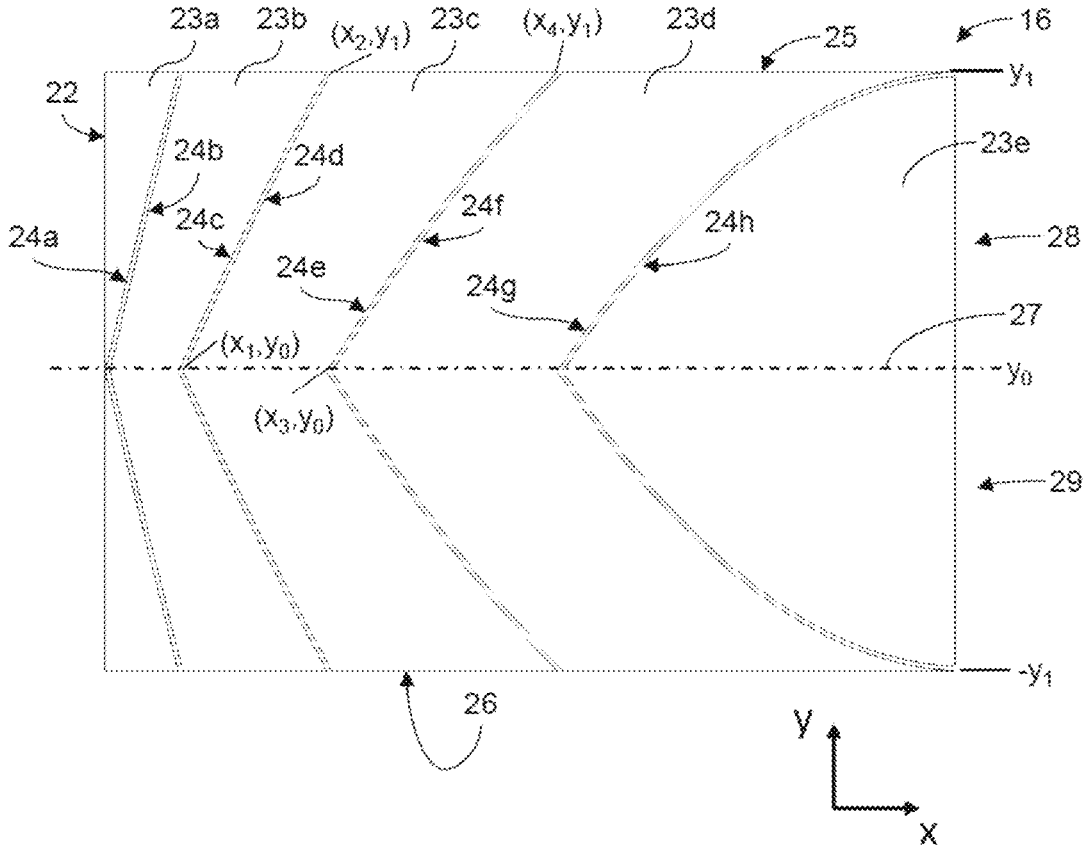
FIG. 3 is a schematic plan view of a surface of an anode for a cell of the electrolytic processing apparatus.

At least the layer 18 of the anode 16 of which the surface faces the workpiece 3 is divided into segments 23*a-e*. Adjacent segments 23*a-e* are separated from each other along respective segment edges 24*a-h* (FIG. 3). The segment edges 24*a-e* between adjacent segments 23 form a pair. The pair may be separate by a gap or by electrically insulating material. The width of the gap or separating strip of electrically insulating material imposes a limit on the number of segments 23*a-e* that can be provided, but need not be determinative of the maximum number of segments 23*a-e*.

In any case, the separation means that the segments 23*a-e* are mutually electrically insulated. There is a small coupling due to the fact that the electrolyte between the workpiece 3 and the anode 16, as well as the electrically conducting starter layer on the surface of the workpiece 3 are electrically conducting. The manner in which the segments 23*a-e* are separated is such as to allow adjacent segments 23*a-e* to be maintained at different respective voltages. The coupling is lower than the range that needs to be controlled to apply an adjustable current to each individual segment 23*a-e*. Each segment's voltage difference to the clamp 7 is independently controllable by an associated respective rectifier (not shown). This voltage difference will be referred to as the anode-clamp voltage $Uc_i$, where i is the number of the segment 23 counting from the segment 23*a* proximal to the clamp 7 in the first direction x.

The segment edges 24*a-e* extend partly in the second direction y from a common value $y_0$ of the y-co-ordinate to a first electrode edge 25 extending in the first direction x. In the illustrated embodiment, the segment edges 24*a-e* also extend partly in the opposite sense in the second direction y from the common value $y_0$ of the y-co-ordinate to a second electrode edge 26 extending in the first direction x. The first and second electrode edges 25,26 are thus opposite edges. A line of symmetry 27 is located at the common value $y_0$ of the y-co-ordinate. The anode 16 can be regarded as comprising two halves 28,29, seen in the second direction y.

The segment edges 24*a-e* extend along respective paths of which an angle to the first electrode edge 25 decreases from the common value $y_0$ of the y-co-ordinate to the first electrode edge 25. Also, the angle to the second electrode edge 26 decreases from the common value $y_0$ of the y-co-ordinate to the second electrode edge 26.

The sections of the segment edges 24*a-e* in a first half 28 of the first and second halves 28,29 extend in the same sense in the first direction x from a point at the common value $y_0$ of the y-co-ordinate to the first electrode edge 25, i.e. the value of the x-co-ordinate increases along the path towards the first electrode edge 25. The sections of the segment edges 24*a-e* in the second half 29 extend in the same sense in the first direction x from a point at the common value $y_0$ of the y-co-ordinate to the second electrode edge 26, i.e. the value of the x-co-ordinate increases along the path towards the second electrode edge 26.

In the illustrated embodiment, the paths of the segment edges 24*a-e* are curves. In other embodiments, they may be piecewise linear curves.

In the illustrated embodiment, a point at the first electrode edge 25 on a path of a first of the segment edges 24*a-h* of each segment 23*a-e* has the same x-co-ordinate or a smaller value of the x-co-ordinate as a point at the common value $y_0$ on the path of the other of the segment edges 24*a-h* of that segment 23*a-e*. Taking the third segment 23*c* as an example (FIG. 3), a first segment edge 24*d* extends from the point $(x_1,y_0)$ to the point $(x_2,y_1)$. A second segment edge 24*e* extends from the point $(x_3,y_0)$ to the point $(x_4,y_1)$, where $x_4 \geq x_3$. It follows that each point on the surface of the workpiece 3 faces at most two electrode segments 23*a-e*.

Counting the segments 23*a-e* from the proximal electrode edge 22, a width of the segments 23*a-e*, corresponding to a distance between the segment edges 24*a-h* at the common value $y_0$ of the y-co-ordinate, increases from segment to segment in the x-direction. The segments 23*a-e* become progressively wider, reflecting the fact that the voltage at the surface of the workpiece 3 changes most steeply in the x-direction at the proximal electrode edge 22 when the workpiece 3 is only contacted at that edge 22.

The segment edges 24*a-e* also become progressively more curved in the x-direction. In other words, an angle to the first electrode edge 25 of the paths of a pair of segment edges 24*a-h* between a pair of adjacent segments 23*a-e* at the first electrode edge 25 increases from pair to pair in the x-direction (the paths of the segment edges 24*a-h* forming such a pair are essentially identical in shape). This holds true mutatis mutandis for the angle to the second electrode edge 26.

Figure 6:
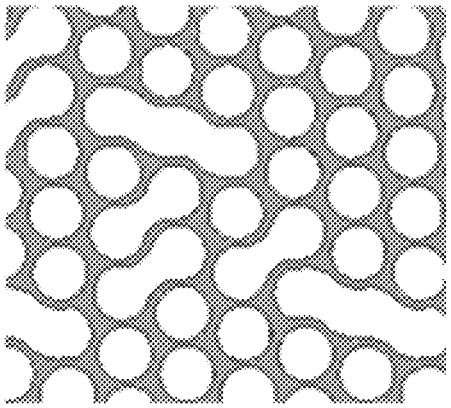
FIG. 6 is a detailed view of a section of the shielding device.

The shielding plate 19 is provided with a multitude of essentially regularly distributed through-going channels, with some adjacent channels being interconnected to form a single channel with a larger cross-sectional area and channels being omitted at certain locations (cf. FIG. 6).

Figure 4:
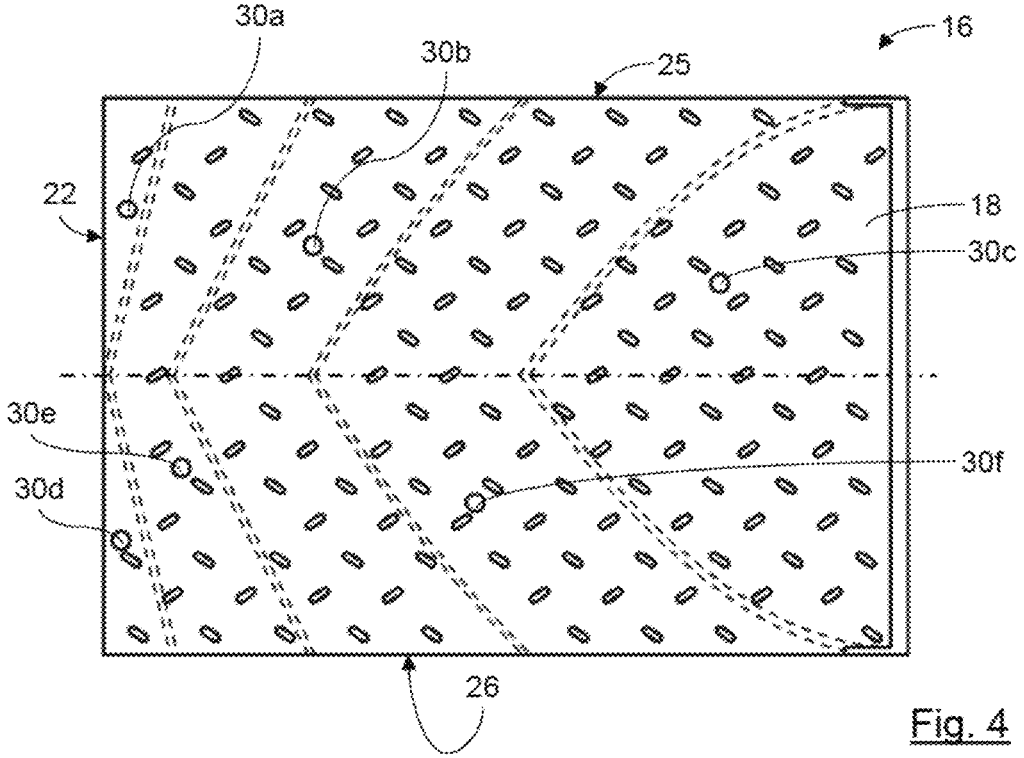
FIG. 4 is a plan view corresponding to that of FIG. 3, but onto an opposite side of the anode.

From the top view of FIG. 4, it will be appreciated that the anode 16 is provided with electrical contacts 30*a-f* extending to the lower layer 18 to contact the segments 23*a-e*. The electrical contacts 30*a-f* are provided at respective locations having a respective x-co-ordinate. An integral of the channel areas in a strip of the shielding plate 19 extending in the second direction y at a corresponding x-co-ordinate is lower than the integral of the channel areas in adjacent parallel strips of the same width. This width will generally be approximately the width of the electrical contact 30*a-f*. Thus, the tendency of current to flow directly to the location of the electrical contact 30*a-f* is countered.

Figure 5:
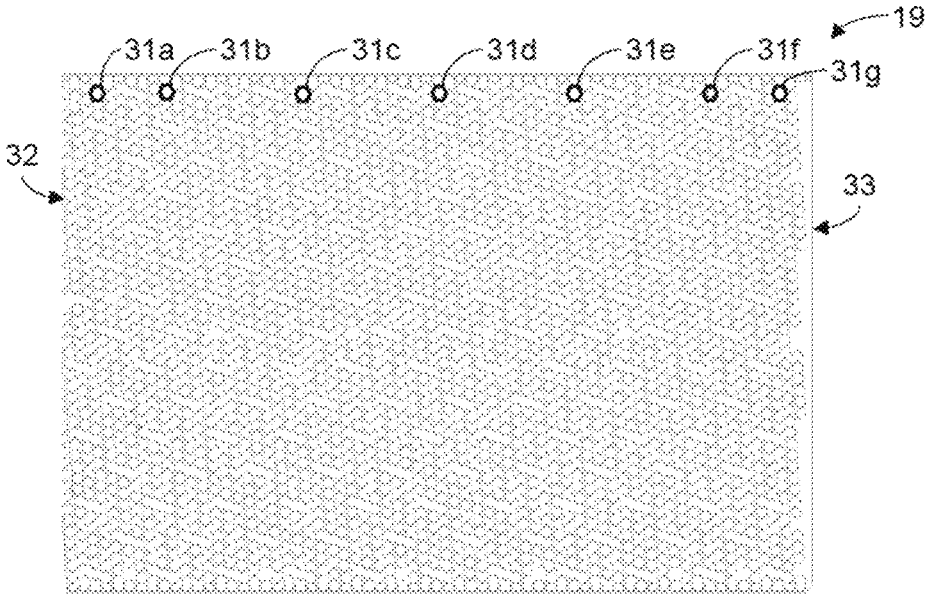
FIG. 5 is a plan view of a shielding device for placement between the anode and the workpiece.

In a similar manner, the shielding plate 19 is fixed by at least one fastener 31*a-g* (only some are shown in FIG. 5 for clarity reasons) extending in a direction transverse to the shielding plate 19 and located at an associated position having a respective x-co-ordinate. The fastener 31 has a cross-section with a certain width at a surface of the shielding plate 19 distal to the anode 16. An integral of the cross-sectional areas of the channels in sections of a strip of the shielding plate 19 with the certain width an extending in the second direction y at the x-co-ordinate is higher than in adjacent sections of adjacent parallel strips of the same width. In other words, the permeability is increased in the strip sections on either side of where the fastener 31 attaches to the shielding plate 19 to compensate for the fact that the fastener 31 behaves as a non-conductive element, despite being made of electrically conducting material.

The shielding plate 19 is also configured to compensate for edge effects.

A proximal shielding plate edge 32 (FIG. 5) proximal in the first direction x to the clamp 7, in use, has an irregular shape. This is to increase an integral of the liquid-pervious area in a strip of the plate extending in the second direction y along that proximal shielding plate edge 32 relative to the corresponding integral in an adjacent parallel strip of the same width. Otherwise, there would be a decrease in current density along the edge of the workpiece 3. The decrease is in principle not a problem, but a local decrease gives rise to an increase in an adjacent strip of the workpiece 3. This is avoided by the increase in permeability at the proximal shielding plate edge 32. Because the channels are of the same size and distributed regularly (with the same pitch), the result is an irregular proximal shielding plate edge 32.

A distal shielding plate edge 33 is configured to counter a steep decrease in current density, in particular if the workpiece 3 has a smaller extent in the first direction x than the anode 16 and the shielding plate 19. An integral of a liquid-pervious area of the channels in a strip of the shielding plate 19 extending in the second direction y along the distal shielding plate edge 33 is lower than in an adjacent parallel strip of the same width. This helps avoid the formation of a rib of plating material along the corresponding distal edge 9 of the workpiece 3.

Figure 9:
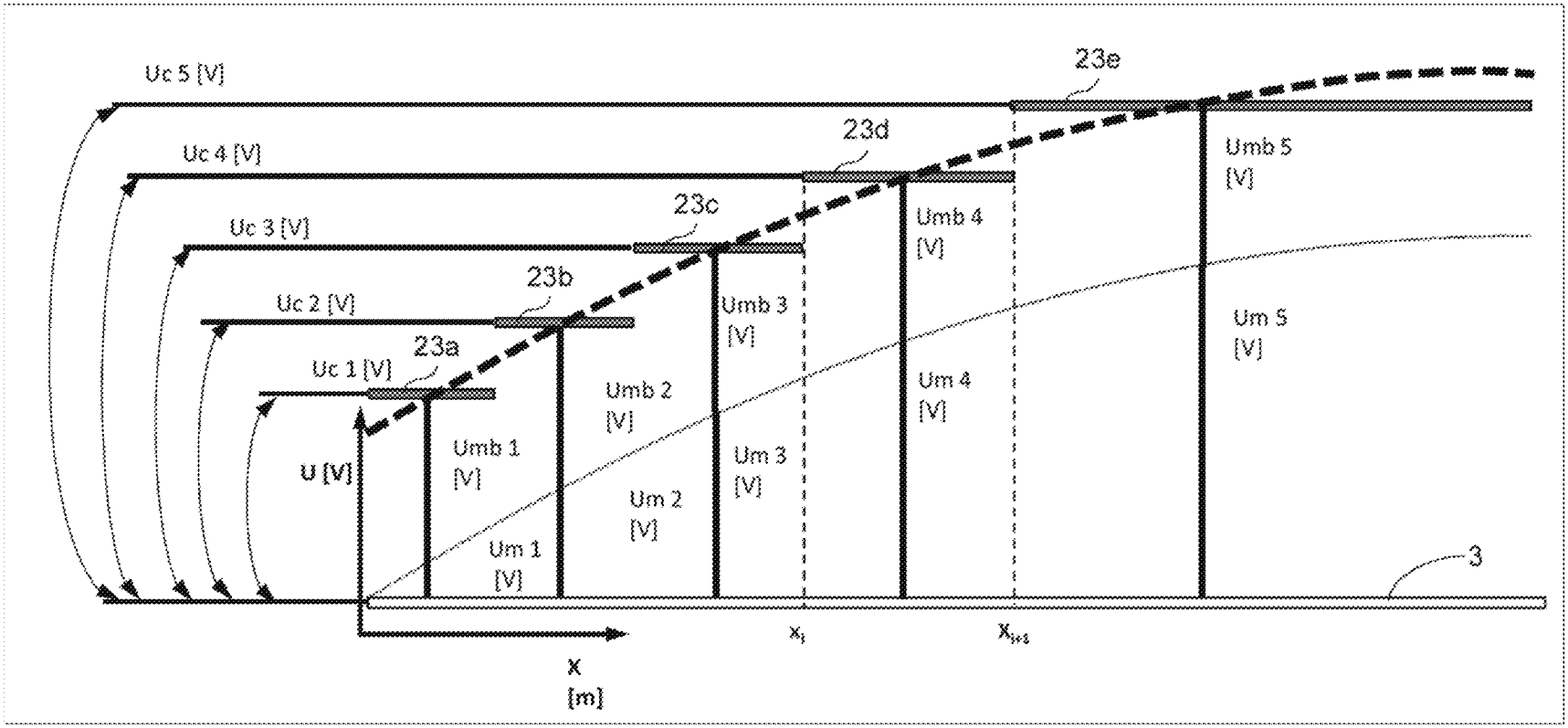
FIG. 9 is a diagram illustrating voltage differences between segments of the anode and the workpiece, the voltage dropoff in an electrolyte bath between the workpiece and the anode and the voltage dropoff in an electrically conducting layer on the surface of the workpiece facing the anode.
Figure 10:
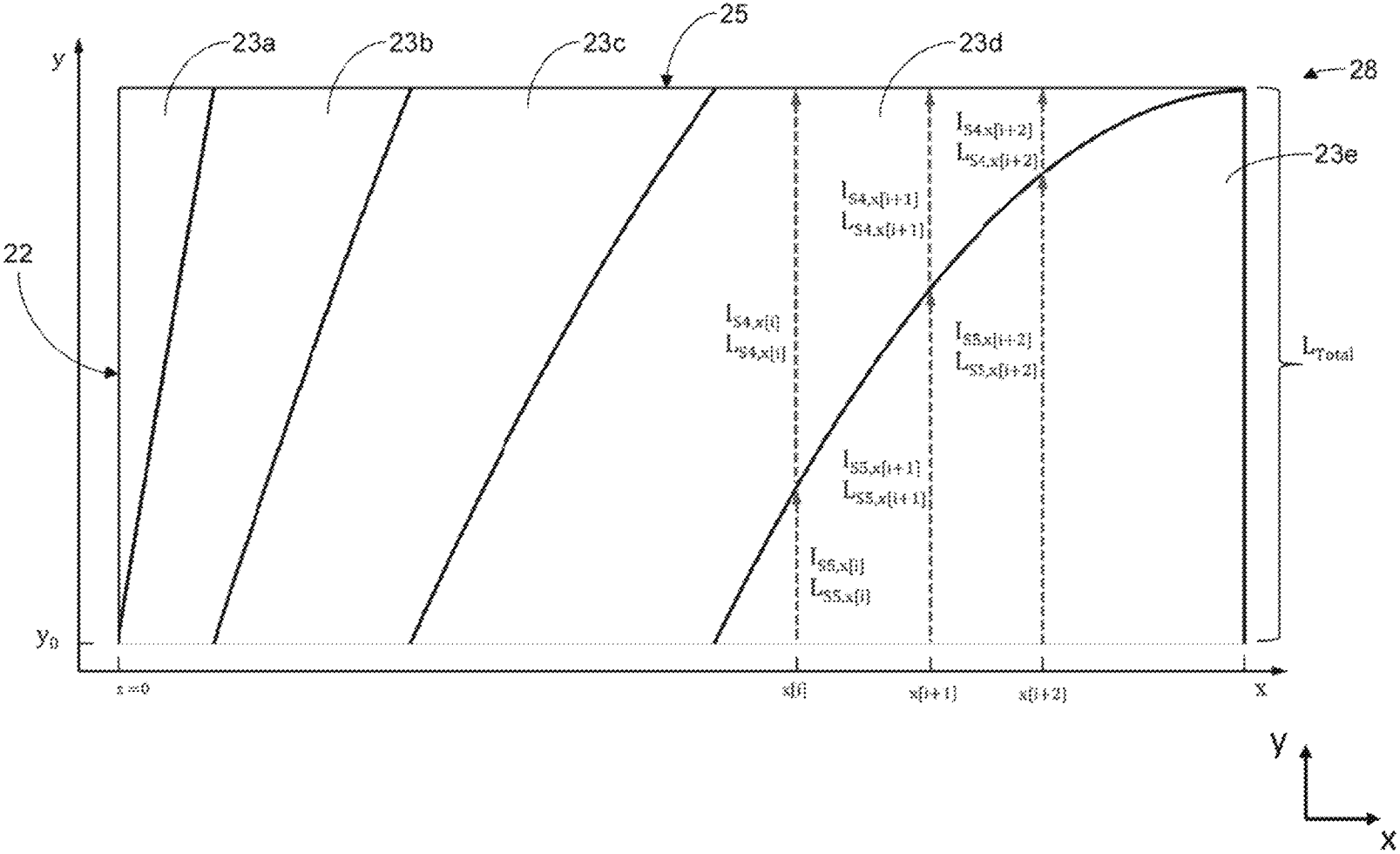
FIG. 10 is a schematic plan view of one half of the anode to illustrate how segment edge shapes are determined.

In a method of obtaining the anode 16, the separation between adjacent segments 23*a-e* is neglected, as illustrated in FIGS. 9 and 10. Each segment edge 24*a-h* is a second-order polynomial. Seen in the first direction x, a point at the first electrode edge 25 of each segment edge 24*a-h* but the last is at the same co-ordinate value x as the point at the common value $y_0$ of the next segment edge 24*a-h*. The number of segments 23*a-e* and the dimensions of the anode 16 are also fixed. Within these constraints, it remains to find the coefficients of the second-order polynomials defining the segment edges 24*a-h*, as well as the potential difference $Uc_i$ with respect to the clamp, where i indicates the number of the segment 23*a-e*, counting from the proximal segment 23*a* in the first direction x.

The potential difference across the bath at the centre of the $i^{th}$ segment, seen in the first direction x, is $Umb_i$. The voltage difference between the corresponding position in the surface layer on the workpiece 3 and the clamp position is $Um_i$, where the clamp is assumed to be at the origin, i.e. x=0. Referring to FIG. 9, the following equations obtain:

$$Umb = Uc - Um, \tag{1}$$

$$Um = \frac{\alpha/3(x_{i+1}^3 - x_i^3) + b/2(x_{i+1}^2 - x_i^2) + c(x_{i+1} - x_i)}{x_{i+1} - x_i}. \tag{2}$$

The dashed graph (FIG. 9) shows the voltage target distribution. Note that Um is simply the average voltage in a segment of the surface layer on the workpiece 3 opposite a particular one of the segments 23*a-e*. The voltage drop-off in the surface layer is a second-order polynomial.

Figure 7:
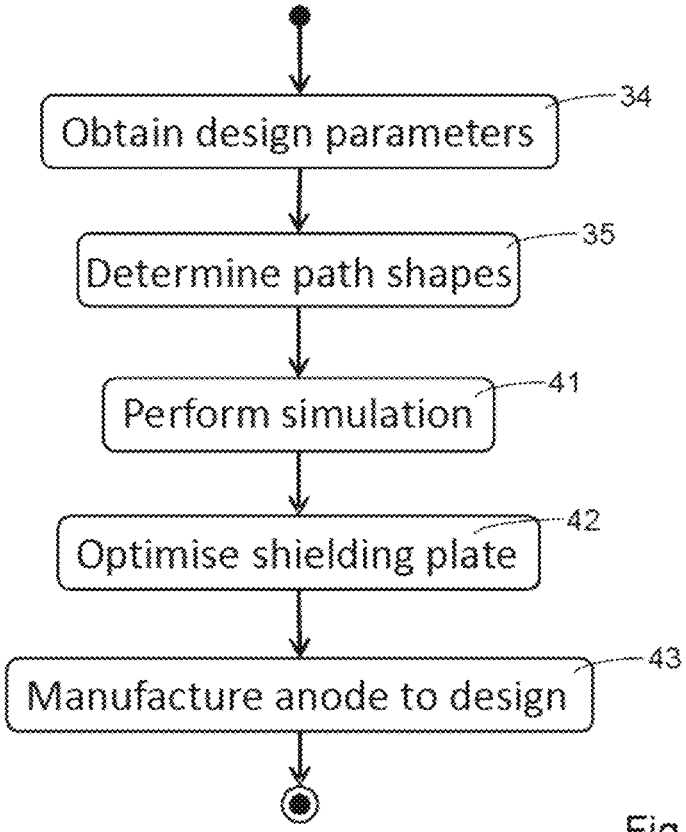
FIG. 7 is a diagram illustrating steps in a method used to obtain the anode.
Figure 11:
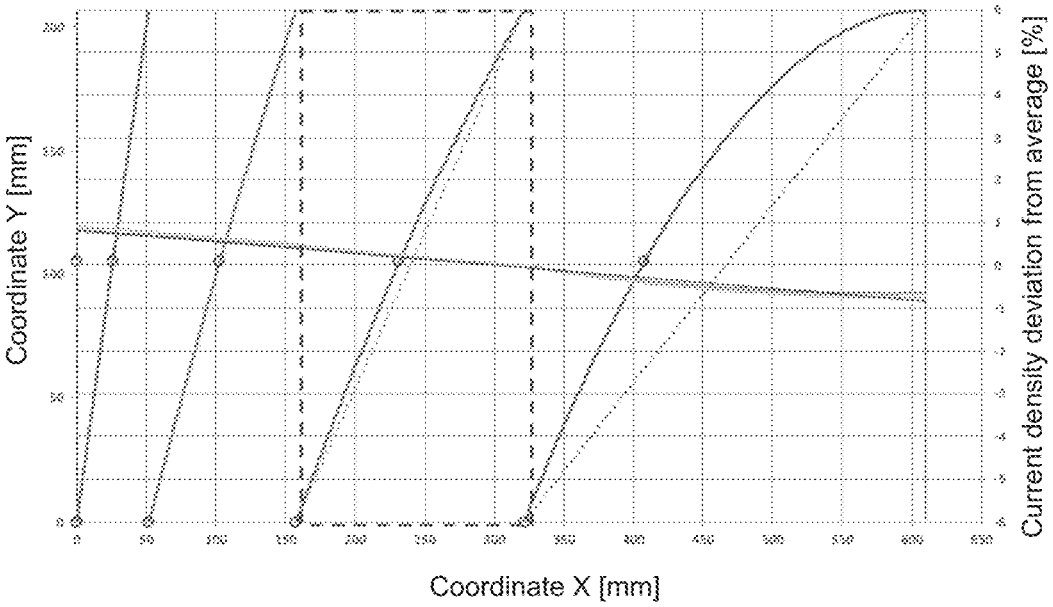
FIG. 11 is a diagram showing a first phase in a determination of the target current density averages for the segments.
Figure 12:
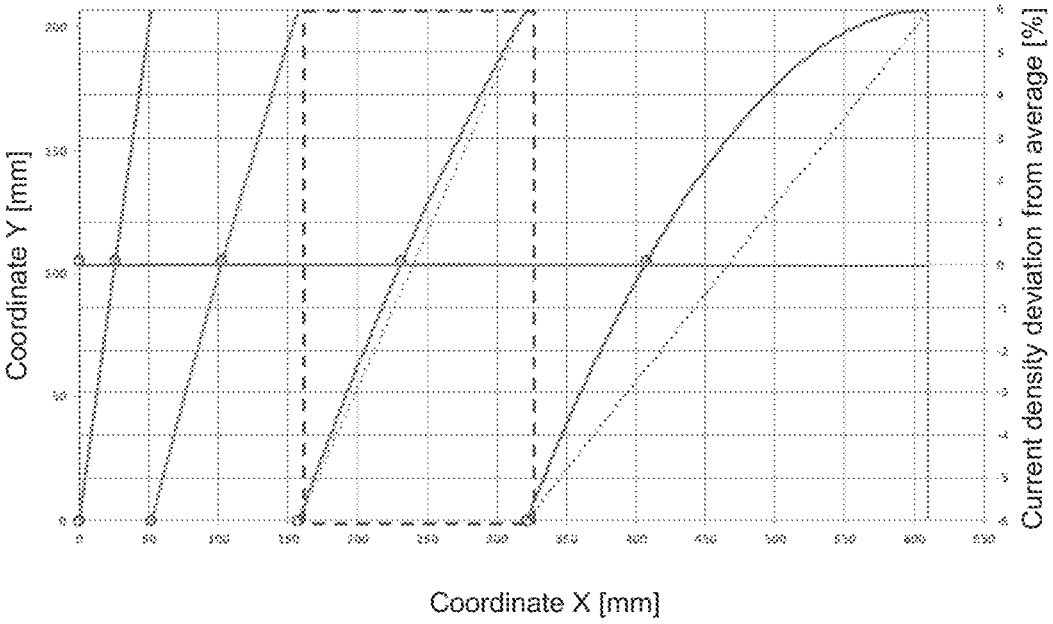
FIG. 12 is a diagram showing a result of the determination of the target current density averages.

In a first step 34 (FIG. 7) of the design process, the design parameters are obtained. These include the thickness of the layer of electrically conducting material on the workpiece 3, the dimensions of the workpiece 3 in the first direction x and the second direction y, the resistivity of the electrolyte, a distance between the surface of the workpiece 3 and a surface of the anode 16 and the resistivity of the conducting material on the workpiece 3. A further requirement is a nominal current density average, the average being over an area of the anode 16. From this result target current density averages for each segment 23*a-e*, according to a formula:

$$CDA[i]=m\cdot i^p+n \tag{3},$$

where i is the segment number, p is an empirically determined fixed value and the values for m and n follow by taking the nominal current density average value for the final segment (e.g. i=5 in the illustrated embodiment) and a particular value for the first segment (i=1), which is determined through trial and error. This process is illustrated in FIGS. 11 and 12. FIG. 11 shows the result of taking too large a value for the current density average in the first segment CDA[1]. FIG. 12 shows the result of adjusting this value down to an appropriate value. The values of the current density average for all the other segments 23*a-e* are obtained using equation (3).

In a next step 35, the shapes of the paths of the segment edges are determined.

Figure 8:
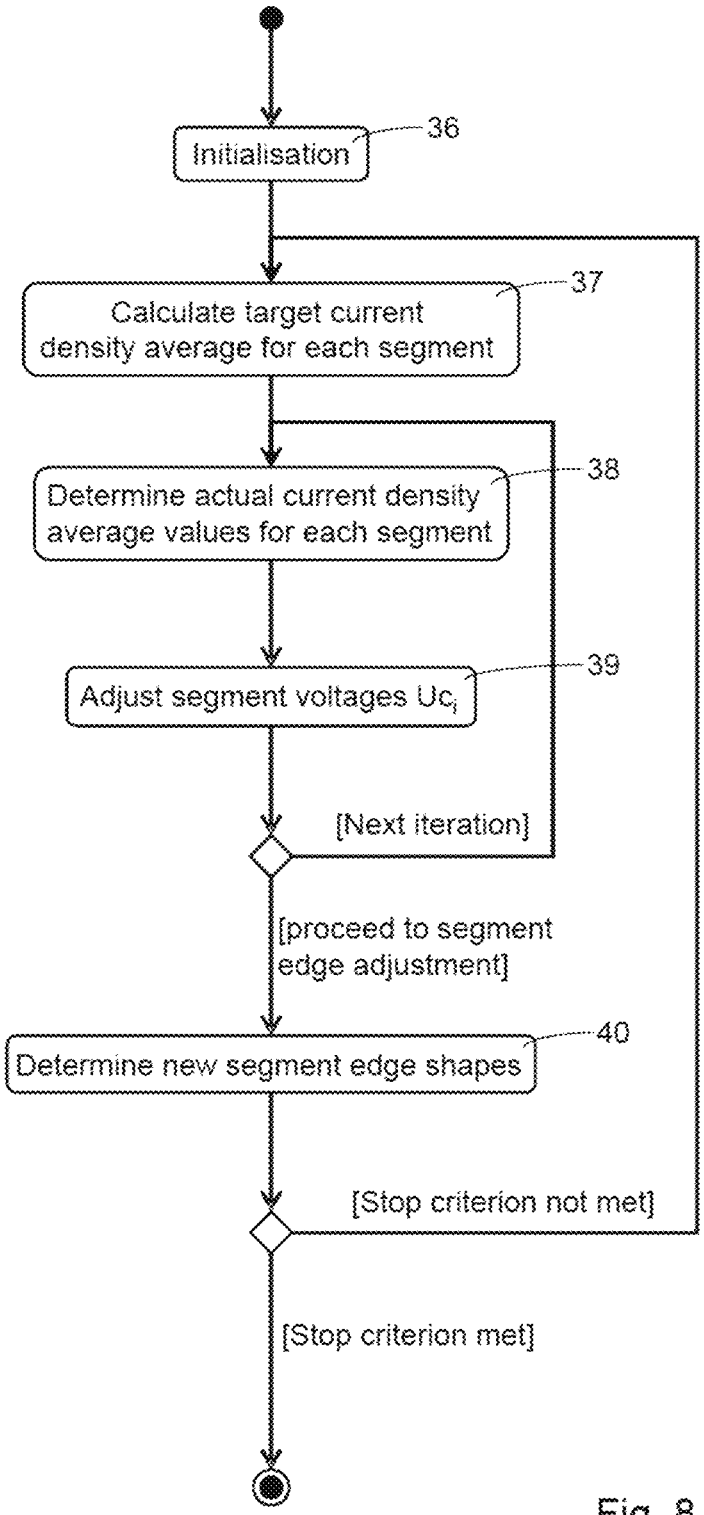
FIG. 8 is a diagram illustrating an implementation of one of the steps of FIG. 7.

As illustrated in FIG. 8, this step 35 involves an initialisation (step 36) and calculation (step 37) of the target current density average for each segment 23*a-e*, according to equation (3).

Thereafter follow a series of iterations of steps.

First (step 38), the current density average is calculated for each segment 23*a-e*. This involves dividing the first half 28 into narrow strips extending from the proximal electrode edge 22 to the opposite edge in the first direction x, each strip having a relatively small dimension in the second direction y. With the voltage drop-off function and the values of the segment voltages $Uc_i$, the current contributions for each segment 23*a-e* can be calculated for that narrow strip. The contributions of all the narrow strips are then summed to find the current for each segment 23*a-e*, which is divided by the area of that segment. The resulting values are compared with the target values and the values $Uc_i$ are adjusted to decrease the deviations (step 39). The calculation (steps 39,38) is repeated to bring the current density averages for the segments 23*a-e* closer to the target values or until another stop criterion (e.g. a certain number of iterations) is met.

Next (step 40), the segment edges 24*a-h* are adjusted.

FIG. 10 shows the first half 28 of the anode 16. The dashed lines correspond to paths that a point on the workpiece 3 faces as the workpiece 3 is moved in the second direction y. In an electroplating process, the amount of metal deposited is proportional to the electric charge Q. The electrical charge Q is defined by the electrical current I multiplied by the time t:

$$Q=I\cdot t \tag{3}.$$

It is assumed that a velocity v of the workpiece 3 is constant:

$$v=L/t, \tag{4}$$

where L is the dimension of the first half 28 of the anode 16 in the second direction y. At each position in the first direction x, the time t is the same, so that the charge is the product of the current I and the length L for each point on the workpiece 3 that moves past only one segment 23*a-e*.

To achieve an equal metal deposition for each location x[i] in the first direction x, the collected electrical charge Q must be the same. This leads to the following constraints:

$$L_{S5,x[i]}\cdot I_{S5,x[i]}+L_{S4,x[i]}\cdot I_{S4,x[i]}=Q[i]\cdot v,$$

$$L_{S5,x[i+1]}\cdot I_{S5,x[i+1]}+L_{S4,x[i+1]}\cdot I_{S4,x[i+1]}=Q[i+1]\cdot v,$$

$$L_{S5,x[i+2]}\cdot I_{S5,x[i+2]}+L_{S4,x[i+2]}\cdot I_{S4,x[i+2]}=Q[i+2]\cdot v,$$

where v and Q are constants.

The anode segments 23*a-e* are divided into narrow strips of equal size extending in the y-direction. Each strip extends through two neighbouring segments 23*a-e*. Because the segments 23*a-e* are at different voltages, the local currents that enter the workpiece 3 are also different. The currents along the strips are summed, reflecting the fact that the workpiece 3 passes in front of the entire anode 16.

The conducting layer on the workpiece 3 is modelled as a one-dimensional chain of resistances, each having a length in the x-direction corresponding to the distance between one strip to the next. This allows one to model the currents as entering at the nodes of the chain of resistances. From this results a voltage drop-off allowing to calculate a new voltage drop-off function. This function is a second-order polynomial, as mentioned. The coefficients of the polynomial determine the shapes of the segment edges 24*a-h*, which are corresponding second-order polynomials. With the new shapes of the segment edges 24*a-h* obtained in the second step 40, the method returns to the calculation of the segment voltages $Uc_i$.

The iterations are repeated until a break-off criterion is satisfied (e.g. a fixed number of iterations, a particular maximum deviation of the current density averages from the target values, or the like). The break-off criterion in one particular embodiment is that the respective current contributions of the strips defined in the step 40 of adjusting the segment edges 24*a-h* are equal (or differ by less than a pre-determined maximum allowable deviation).

In an optional further step 41 (FIG. 7), the current density is calculated by means of simulation across the surface of the workpiece 3. The permeability of the shielding plate 19 is then (optional step 42) locally adjusted such as to reduce the deviations of the current density from an average value. This takes account of the separation between adjacent segments 23*a-e* neglected in the calculation of the shape of the segment edges 24*a-h*. The two steps 41,42 are carried out iteratively to arrive at an optimal aperture distribution for the shielding plate 19.

Finally (step 43), the anodes 16 are manufactured to the design.

Figure 13:
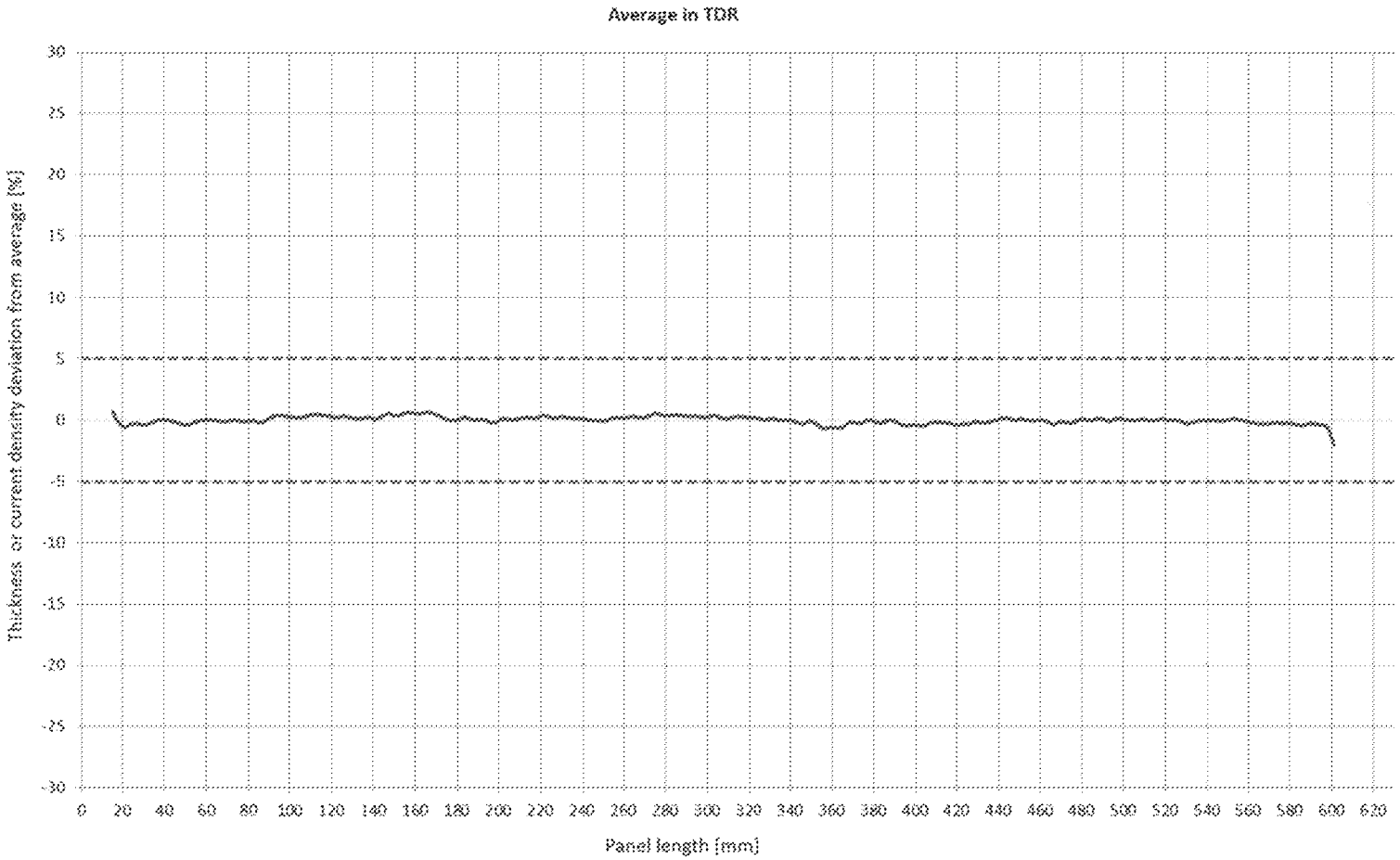
FIG. 13 is a diagram showing a percentage deviation of a current density at positions along a workpiece length from an average current density, calculated by simulating a cell comprising an anode of the type illustrated in FIGS. 3, 4 and 10 and a shielding device as shown in FIGS. 5 and 6.

A simulation of an anode 16 designed in such a process shows that the deviations from the average current density remain within 5% across the extent of the workpiece 3 in the first direction x (FIG. 13), except for small strips at the edges 8,9.

The invention is not limited to the embodiments discussed above, which may be varied within the scope of the accompanying claims. An improvement in the uniformity of the current density is, for example, also achieved without the shielding plate 19 discussed above.

List of reference numerals

| | |
|---|---|
| 1 | apparatus |
| 2a-d | cells |
| 3a-f | workpieces |
| 4 | enclosure |
| 5a-c | rollers |
| 6 | conveying system |
| 7 | clamp |
| 8a-f | proximal workpiece edges |
| 9a-d | distal workpiece edges |
| 10 | belt |
| 11a, b | drums |
| 12 | arm |
| 13 | core part |
| 14 | core part shielding |
| 15 | core part surface section |
| 16 | anode |
| 17 | upper layer |
| 18 | lower layer |
| 19 | shielding plate |
| 20 | clamp anode |
| 21 | clamp anode surface |
| 22 | proximal electrode edge |
| 23a-e | segments |
| 24a-h | segment edges |
| 25 | first electrode edge |
| 26 | second electrode edge |
| 27 | line of symmetry |
| 28 | first half |
| 29 | second half |
| 30a-f | electrical contacts |
| 31a-g | fasteners |
| 32 | proximal shielding plate edge |
| 33 | distal shielding plate edge |
| 34 | step (obtain design parameters) |
| 35 | step (determine path shapes) |
| 36 | step (initialisation) |

-continued

List of reference numerals

| | |
|---|---|
| 37 | step (calculate target current density average for each segment) |
| 38 | step (determine actual current density average values for each segment) |
| 39 | step (adjust segment voltages) |
| 40 | step (determine new segment edge shapes) |
| 41 | step (perform simulation) |
| 42 | step (optimise shielding plate) |
| 43 | step (manufacture anode to design) |

The invention claimed is:

1. An electrode component of an apparatus (1) for electrolytically treating a workpiece (3), comprising:

the apparatus (1) holds the electrode and is arranged to convey the workpiece (3) with a surface to be treated through an electrolyte vertically or horizontally past and directed towards a surface of the electrode, wherein the electrode is divided into segments (23*a-e*) on at least the surface of the electrode directed towards the surface to be treated, wherein the segments (23*a-e*) are arranged next to each other in a first direction (x), wherein adjacent segments (23*a-e*) are separated from each other along respective segment edges (24*a-f*) such as to allow adjacent segments (23*a-e*) to be maintained at different respective voltages, and wherein the segment edges (24*a-f*) extend at least partly in a second direction (y) from a common value ($y_0$) of a coordinate in the second direction (y) to an edge (25,26) of at least an electrically conducting part of the electrode surface, the second direction (y) being transverse to the first direction (x) and the second direction (y) being direction of movement of the workpiece, wherein the segment edges (24*a-f*) between at least one pair of adjacent segments (23*a-e*) extend along respective paths of which an angle to the electrode surface edge (25,26) decreases from the common value (y0) of the coordinate to the electrode surface edge (25,26), and wherein shape of at least one pair of the segment edges (24*a-f*) are determined by coefficients of a second-order polynomial, and the segment edges (24*a-f*) between at least one pair of adjacent segments (23*a-e*) include curved segment edges and segment edges (24*a-f*) between at least one pair of adjacent segments include straight segment edges, wherein the paths of the segment edges (24*a-f*) are comprised of two sections that are mirror images of each other, and wherein, at least within each half of the electrode seen in the first direction (x), the paths extend in a same one or opposite manner in the first direction (x) from the common value ($y_0$) of the coordinate to the electrode surface edge (25,26), so that the paths are all inclined in the same direction, at least within each half of the electrode viewed in the first direction (x).

2. The electrode according to claim 1, wherein the paths from the common value ($y_0$) of the coordinate to the electrode surface edge (25,26) comprise curves.

3. The electrode according to claim 1, wherein at least the electrically conducting part of the electrode surface comprises two halves (28,29), seen in the second direction (y), wherein respective sections of the segment edges (24*a-f*) in one half (28,29) are a mirror image of respective sections of the segment edges (24*a-f*) in the other half (28,29) with respect to a line (27) of symmetry located at the common value ($y_0$) of the coordinate.

4. The electrode according to claim 1, wherein a point at the electrode surface edge (25,26) on a path of a first of the segment edges (24*a-f*) of each segment (23*a-e*) is at the same coordinate value or removed in the first direction (x) from a point at the common value ($y_0$) of the coordinate on the path of the other of the segment edges (24*a-f*) of that segment (23*a-e*).

5. The electrode according to claim 1, wherein a width of the segments (23*a-e*), corresponding to a distance between the edges (24*a-h*) of a segment (23*a-e*) at the common value ($y_0$) of the coordinate, increases from segment (23*a-e*) to segment (23*a-e*), so that the segments (23*a-e*) become progressively wider with distance in the first direction (x) from an electrode edge (22), or wherein this condition holds true within each half of the electrode, viewed in the first direction (x).

6. The electrode according to claim 1, wherein an angle to the electrode surface edge (25,26) of the paths of a pair of segment edges (24*a-f*) between a pair of adjacent segments (23*a-e*) at the surface edge increases from pair to pair with distance in the first direction (x) from an electrode edge (22), or wherein this condition holds true within each half of the electrode, viewed in the first direction (x).

7. The electrode according to claim 1, wherein, viewed in plan view onto the electrode surface, at least one path from the common value ($y_0$) of the coordinate in the second direction (y) to the edge (25,26) is at least based on coefficients of a higher-order polynomial.

8. An assembly for forming a cell (2*a-e*) of an electrolytic processing apparatus (1), wherein the assembly comprises at least one electrode (16) according to claim 1.

9. An assembly according to claim 8, further comprising at least one shielding device, extending in the first and second directions (x,y) in front of the electrode surface of one of the at least one electrodes (16).

10. An assembly according to claim 9, wherein the shielding device comprises a plate (19), provided with a multitude of through-going channels pervious to liquid and distributed in the first and second directions (x,y).

11. An electrolytic processing apparatus comprising at least one processing cell (2*a-e*), the processing cell (2*a-e*) comprising at least one assembly according to claim 8.

* * * * *